US005951942A

United States Patent [19]

Rossillon et al.

[11] Patent Number: 5,951,942

[45] Date of Patent: Sep. 14, 1999

[54] PROCESS FOR FORMING A SINGLE LAYER BATT FROM MULTIPLE CURTAINS OF FIBERS

[75] Inventors: Daniel F. Rossillon, Signal Mountain; John A. Rodgers, Ooltewah; Roger A. Ross, Chattanooga, all of Tenn.

[73] Assignee: Conoco Inc., Ponca City, Okla.

[21] Appl. No.: 09/103,085

[22] Filed: Jun. 23, 1998

Related U.S. Application Data

[62] Division of application No. 08/649,751, May 15, 1996, Pat. No. 5,863,565.

[51] Int. Cl.[6] ..... D01D 5/12; D01F 9/12; D04H 3/00

[52] U.S. Cl. ..... 264/555; 264/103; 264/211.11; 264/211.14

[58] Field of Search ..... 264/103, 211.11, 264/211.14, 555

[56] References Cited

U.S. PATENT DOCUMENTS

| | | | |
|---|---|---|---|
| 3,825,379 | 7/1974 | Lohkamp et al. | 425/72.2 |
| 4,052,183 | 10/1977 | Levecque et al. | 264/211.14 X |
| 4,402,900 | 9/1983 | Berry, Jr. | 264/205 |
| 4,606,872 | 8/1986 | Watanabe | 264/29.2 |
| 4,670,202 | 6/1987 | Uenoyama et al. | 264/39 |
| 4,826,415 | 5/1989 | Mende | 425/72.2 |
| 4,838,774 | 6/1989 | Balk | 264/211.14 X |
| 5,080,569 | 1/1992 | Gubernick et al. | 264/211.14 X |
| 5,098,636 | 3/1992 | Balk | 264/555 |
| 5,102,484 | 4/1992 | Allen et al. | 156/244.11 |
| 5,112,562 | 5/1992 | Mende | 264/555 |
| 5,141,699 | 8/1992 | Meyer et al. | 264/518 |
| 5,160,746 | 11/1992 | Dodge, II et al. | 425/7 |
| 5,196,049 | 3/1993 | Coombs et al. | 75/338 |
| 5,286,182 | 2/1994 | Maeda et al. | 425/72.1 |
| 5,476,616 | 12/1995 | Schwarz | 264/6 |
| 5,648,041 | 7/1997 | Rodgers et al. | 264/555 |

FOREIGN PATENT DOCUMENTS

| | | | |
|---|---|---|---|
| 2008375 | 2/1994 | Russian Federation | 425/72.2 |

*Primary Examiner*—Leo B. Tentoni
*Attorney, Agent, or Firm*—William D. Hall

[57] ABSTRACT

The present invention provides a process and for producing a single layer batt of fibers prepared by multiple die tips. The present invention also provides a novel multiple tip blow spinning die.

10 Claims, 1 Drawing Sheet

PROCESS FOR FORMING A SINGLE LAYER BATT FROM MULTIPLE CURTAINS OF FIBERS

Figure 1:
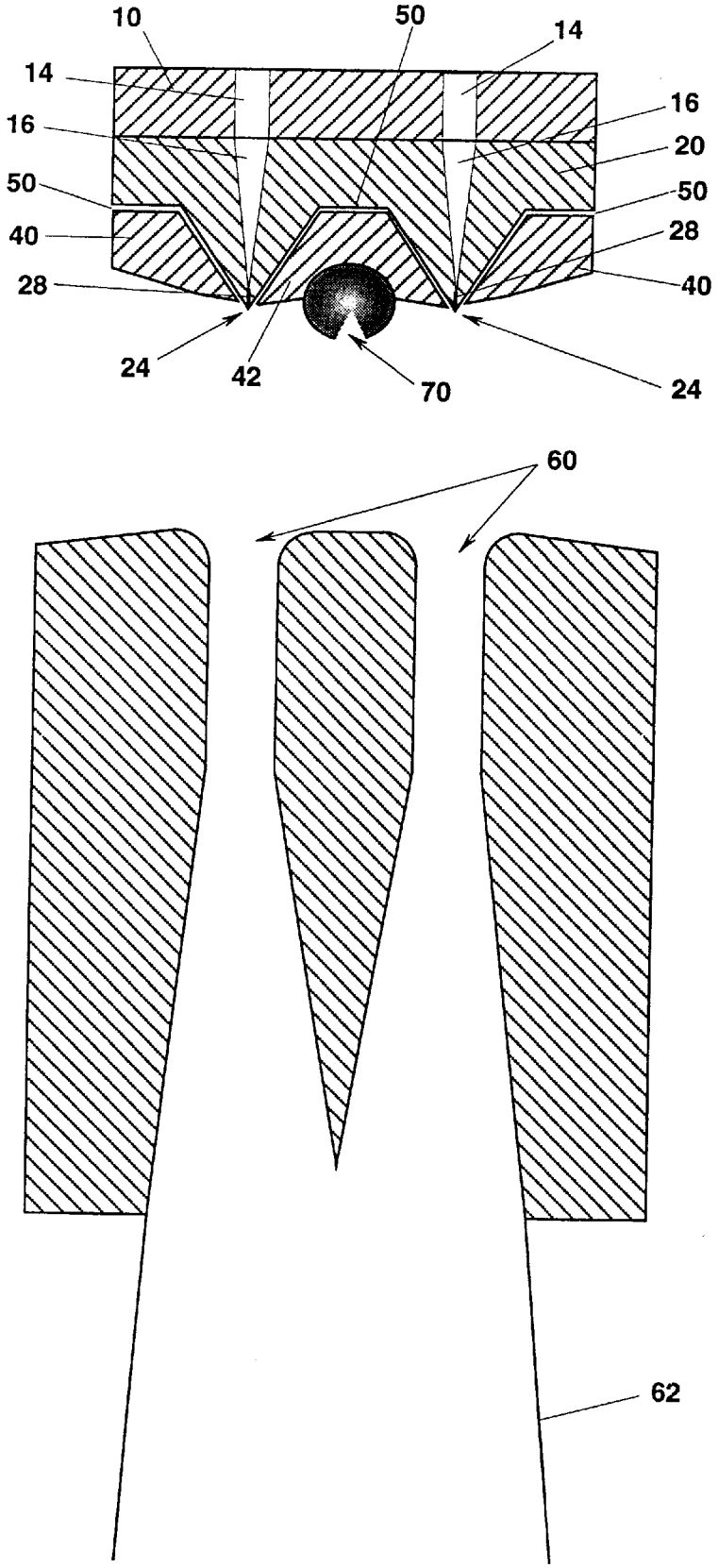

This is a division of application Ser. No. 08/649,751 filed May 15, 1996 which issued on Jan. 26, 1999 as U.S. Pat. No. 5,863,565.

I. BACKGROUND AND SUMMARY OF THE INVENTION

A. Summary of the Invention

The present invention provides an apparatus for economically increasing the production capacity of fiber blow spinning units. Additionally, the present invention provides a method and apparatus for collecting blow spun fibers in a single layer batt. Accordingly, the present invention provides a multi-tip linear blow spinning slot die.

B. Background of the Invention

The article, "Superfine Thermoplastic Fibers," by Van A. Wente, *Industrial and Engineering Chemistry,* Vol. 48, No. 8, August 1956, pp. 1342–46, demonstrates the common methods and devices for blow spinning fibers. The described process includes the steps of heating a spinnable substance to a temperature which will allow it to flow. Following heating, the substance passes, usually under pressure, into a spinning die and through one or more capillaries to form a fiber. Upon exiting the capillary, the fiber is contacted with an attenuating media, usually a gas, which draws or stretches the fiber.

The several types of dies utilized for blow spinning fibers include annular dies and slot dies. Annular and slot dies primarily differ in the manner in which the attenuating gas is directed upon the exiting fiber. In an annular die, the attenuating gas passes parallel to the as-spun fiber. In contrast, slot dies direct the attenuating gas onto the as-spun fiber at an angle determined by the die's cheek plates. While described in terms of a slot die, one skilled in the art will recognize that the present invention has equal application for all types of blow spinning dies.

While the process for blow spinning fibers are well known, efforts continue to maximize the production capacity of the blow spinning die. In general, the production capacity of a die is determined by the flow rate of the spinnable substance through the capillaries, the number/spacing of the capillaries in the die, the length of the die and in general the ability to machine a die of a given length to the necessarily strict tolerances. As recognized by U.S. Pat. No. 3,825,379, the accurate alignment of spinning capillaries over long distances is very difficult. In view of the difficulties in machining long blow spinning dies, the inventors of the current invention sought to develop an alternative means for increasing the production capacity of blow spinning dies.

Accordingly, the present invention provides a multiple tip blow spinning die. The use of a multi-tip die increases the capacity of a single die for any given length. Further, the use of a multi-tip die allows the use of shorter dies without the loss of production capacity. The use of a shorter die is particularly valuable when spinning substances which commonly plug capillaries, such as carbonaceous pitch. When used in production, several shorter dies will take the place of one long die, thereby allowing the operator to service a single die without halting production of an entire line.

Finally, the present invention also provides a process for combining the multiple curtains of fibers generated by the improved spinning apparatus into a single curtain of fibers which may then be collected as a single layer batt on a moving belt. The process combines the improved spinning apparatus with a venturi/diffusion chamber as described in U.S. Pat. No. 5,648,041. In the present invention, the venturi/diffusion chamber has been expanded to provide a single venturi for each curtain of fibers. Subsequently, the curtains pass from each venturi into a single diffusion chamber. Although applicable in almost all blow spinning applications, the process of the present invention is particularly useful when spinning fibers from a carbonaceous pitch such as solvated mesophase pitch.

II. BRIEF DESCRIPTION OF THE INVENTION

The present invention provides an improved blow spinning die assembly and a process for producing a single batt of fibers from multiple die tips. The improved blow spinning die assembly has a distribution plate which receives a spinnable substance from a multi-outlet spinning pump or multiple spin pumps. The distribution plate is attached to a slot die body having multiple die tips. The die tips contain spinning capillaries having openings at the terminus of each die tip. The capillaries are in fluid communication with the distribution plate and receive the spinnable substance from the distribution plate. The capillaries form the spinnable substance into fibers as it passes through the capillaries, exiting the capillaries at the terminus of the die tip.

Positioned adjacent to each die tip and attached to the slot die are cheek plates. The cheek plates are attached in a manner to form a passage between the slot die and the cheek plate. These passages open at the region adjacent to the terminus of the die tips and provide a means for directing an attenuating gas onto the fibers as they emerge from the capillaries. Finally, the cheek plates positioned between die tips may contain a port or opening as a means for providing supplemental gas to the spun fibers.

The process of the present invention provides a means for forming a single layer batt of fibers when the fibers are produced by multiple die tips. Accordingly, multiple curtains or sheets of fibers are produced by means of a single blow spinning die having multiple tips. The fibers are attenuated by an attenuating gas as they exit the spinning die. Following attenuation, the curtains of fibers are contacted by a supplemental gas stream as each curtain enters a separate venturi. The supplemental gas stream and the venturi operate to maintain tension on the fibers assuring the formation of primarily straight fibers. The fiber curtains pass from each venturi into a single diffusion chamber. Within the diffusion chamber, the curtains are mingled and blended as the supplemental gas stream dissipates. The fibers, now a single curtain or sheet, exit the diffusion chamber and are collected preferably on a moving belt. Depending upon the method of collection, the single curtain of fibers may be allowed to fold back on themselves creating multiple layers of fibers in the batt. Alternatively, a belt moving at sufficient speed may collect the fibers as a single layer batt.

III. BRIEF DESCRIPTION OF THE DRAWING

FIG. 1 is a side cut a way view of the apparatus of the present invention including the multi-tip die, the venturi and the diffusion chamber.

IV. DETAILED DESCRIPTION OF THE INVENTION

A. The Multi-Tip Blow Spinning Apparatus

The preferred embodiment of the present invention will be described with reference to FIG. 1, wherein like structures are designated by identical numbers. The multi-tip blow spinning die of the present invention was designed initially to improve the production efficiencies of blow spinning carbonaceous pitch fibers. In particular, the present invention is useful for blow spinning fibers from solvated mesophase pitch. However, the present invention will provide advantages in most blow spinning applications.

With reference to the drawing, the improved blow spinning apparatus includes a distribution plate 10 which receives a spinnable substance such as carbonaceous pitch from multiple spinning pumps or a single spinning pump having multiple outlets (not shown). By means of passages 14, distribution plate 10 evenly distributes the spinnable substance to a slot die 20. Slot die 20 has at least two die tips 24. Each die tip has multiple capillaries 28 which are in fluid communication with distribution plate 10. In the present embodiment, passages 16 provide fluid communication between capillaries 28 and distribution plate 10. The capillaries 28 exit each die tip 24 at its terminus. Capillaries 28 are of a suitable length and diameter to generate fibers from the spinnable substance. Positioned adjacent to each die tip 24 are cheek plates 40 and 42. Cheek plates 40 and 42 are attached to slot die 20 in a manner to form passages 50 between the die tips and the cheek plates. These passages terminate in the region of the terminus of each die tip 24 and provide a means for directing an attenuating gas onto the fibers as they exit capillaries 28.

In addition to the improved blow spinning die, the present invention utilizes multiple venturi openings 60 in conjunction with a single diffusion chamber 62. The benefits of the venturi/diffusion chamber apparatus are described in U.S. Pat. No. 5,648,041, incorporated herein by reference. When used in the current invention, the venturi/diffusion chamber is expanded to provide a venturi opening 60 for each die tip 24. Additionally, a port or opening 70 for providing a supplemental gas stream can be incorporated into the blow spinning die. In the preferred apparatus, port 70 is incorporated into the central cheek plate 42. As the number of die tips 24 increase, the number of supplemental gas ports 70 can be increased. Preferably, the additional ports 70 will be located in those cheek plates 42 positioned between two die tips 24. In this manner, the gas stream provided to port 70 may be generated by the same mechanism which provides the attenuating gas to passages 50. However, the only requirement for the location of port 70 is that the position provides the requisite flow of gas to the fibers and venturi 60.

Finally, as noted above, the present invention is particularly useful in the blow spinning of carbonaceous pitch fibers from solvated mesophase pitch. If necessary, when used to blow spin carbonaceous pitch fibers, the present invention may be enclosed in a chamber (not shown) to prevent the release of volatile compounds. Additionally, a belt or other means to collect the fibers and transport them away from the apparatus for further processing may be included with or without an isolating chamber.

While the apparatus of the present invention has been described in terms of a double tip die, one skilled in the art will recognize that manufacturing costs will be the only limitation on the number of tips per die. Further, the number of capillaries over a given distance will be determined by the nature of the spinnable substance and the ability to machine a die tip of a given length. Finally, while the present invention has been described in terms of a slot die, one skilled in the art will recognize that the current invention has equal application in annular dies and other blow spinning dies.

B. Process for Forming a Single Layer Batt from Multiple Curtains of Fibers

In conjunction with the above described apparatus, the present invention provides a process for forming multiple curtains of fibers into a single curtain which may be collected as a single layer batt. Prior to the current invention, individual batts of fibers would be collected on a moving belt. As the belt passed beneath each spinning die, distinct layers of fibers would be formed. During subsequent handling of the fibers, these individual layers tended to delaminate, thereby significantly reducing the integrity of the batt. However, as described below, the present invention provides a process for generating a single layer batt, having increased integrity, by combining multiple curtains of blow spun fibers into a single curtain of fibers.

The present invention is particularly valuable when spinning multiple curtains of fibers from solvated pitch. Due to the unique properties of solvated pitch, particularly solvated mesophase pitch, common spinning methods tend to produce fibers having multiple kinks and bends. These irregularities lower the tensile strength of the resulting fiber. In contrast, fibers prepared using the venturi/diffusion chamber are primarily straight fibers.

In the preferred process, multiple curtains of fibers are generated by a multi-tip spinning die. Upon exiting the spinning die, the individual fibers are attenuated by a gaseous stream. Following attenuation, a supplemental gas stream contacts the fibers as they pass into a venturi. According to the preferred embodiment, an individual venturi is provided for each curtain of fibers. The combination of the supplemental stream of gas and the venturi operate to maintain tension on the as-spun fiber. This tension significantly reduces and in most instances precludes the formation of kinks and bends in the fiber.

The fiber curtains exit each venturi and enter a single diffusion chamber. In the present invention, the diffusion chamber serves two purposes. As described in U.S. Pat. No. 5,648,041, the diffusion chamber dissipates the supplemental gas stream. However, in the current invention, the diffusion chamber also utilizes the dissipating gas to commingle or blend the fiber curtains into a single curtain. The fibers then exit the diffusion chamber and are collected on a belt or other device. If the speed of the belt is sufficiently high, the fibers will be collected as a single layer batt. However, it may be desirable to decrease the belt speed in order to increase fiber density by allowing the single curtain of fibers to fold back upon itself as it is collected.

Other embodiments of the present invention will be apparent to those skilled in the art from a consideration of this specification or practice of the invention disclosed herein. It is intended that the specification be considered as only exemplary, with the true scope and spirit of the invention being indicated by the following claims.

We claim:

1. A process for forming a single curtain of fibers from multiple curtains of fibers comprising:

(a) spinning multiple curtains of fibers by means of a blow spinning die;

(b) contacting each curtain of fibers with a supplemental stream of gas while passing each of said curtains into a venturi;

(c) passing said curtains of fibers out of said venturi;

(d) blending said curtains of fibers into a single curtain of fibers.

2. The process of claim 1, wherein said blending step takes place within a single diffusion chamber.

3. The process of claim 2, additionally including the step of collecting said single curtain of fibers as a single layer batt on a moving belt.

4. The process of claim 1, wherein said fibers are pitch fibers.

5. The process of claim 1, wherein each curtain of fibers enters an individual venturi.

6. A process for forming a single layer batt of fibers comprising:

(a) forming multiple curtains of fibers by means of a single blow spinning die;

(b) contacting each curtain of fibers with a supplemental stream of gas while passing each of said curtains through a venturi opening;

(c) passing said curtains of fibers out of said venturi;

(d) blending said curtains of fibers into a single curtain of fibers;

(e) collecting said single curtain of fibers as a single layer batt of fibers.

7. The process of claim 6, additionally including the step of collecting said single curtain of fibers on a moving belt as a single layer batt.

8. The process of claim 6, wherein said blending step takes place within a single diffusion chamber.

9. The process of claim 6, wherein said fibers are pitch fibers.

10. The process of claim 6, wherein each curtain of fibers enters an individual venturi.

* * * * *